US005098489A

United States Patent [19]

Yamakawa et al.

[11] Patent Number: 5,098,489

[45] Date of Patent: Mar. 24, 1992

[54] PROCESS FOR MANUFACTURING HIGH-STRENGTH PARTS OF AN AUTOMOBILE TRANSMISSION SYSTEM

[75] Inventors: Tsunahiro Yamakawa; Satoru Nito; Hiroyoshi Yamakawa, all of Fuji; Ichiro Kokubo, Kakogawa; Takuo Hosoda, Akashi; Masakatsu Hata, Kusakabe, all of Japan

[73] Assignees: Yamakawa Industrial Co., Ltd., Fuji; Kabushiki Kaisha Kobe Seiko Sho, Kobe, both of Japan

[21] Appl. No.: 540,127

[22] Filed: Jun. 19, 1990

[51] Int. Cl.[5] ..... C21D 8/02

[52] U.S. Cl. ..... 148/12.3; 148/12.7 R; 148/12 F

[58] Field of Search ..... 148/12.1, 12.3, 12 F

[56] References Cited

U.S. PATENT DOCUMENTS 3,947,293 3/1976 Takechi et al. ..... 148/12 F

FOREIGN PATENT DOCUMENTS 35625 2/1982 Japan ..... 148/12.3

*Primary Examiner*—R. Dean
*Assistant Examiner*—Sikyin Ip
*Attorney, Agent, or Firm*—Oblon, Spivak, McClelland, Maier & Neustadt

[57] ABSTRACT

Steel containing, on a weight percent basis, 0.01 to 0.15% of carbon, 0.05 to 0.50% of silicon, 0.20 to 1.0% of manganese, 0.01 to 0.1% of aluminum, 0.3 to 2.0% of copper, 0.1 to 2.0% of nickel, 0.015 to 0.1% of niobium and 0.0005 to 0.0050% of calcium, the balance of its composition being iron and unavoidable impurities, is heated to a temperature of 1100° C. to 1250° C., and hot rolled. The hot-rolled steel is coiled at a temperature of 350° C. to 500° C. to prepare a hot-rolled steel sheet having a tensile strength not exceeding 65 kgf/mm$^2$. The sheet is cold worked until a working strain of at least 15% is set up. The cold-worked product is heated at a temperature of 400° C. to 550° C. for 0.5 to three hours to yield a part having a tensile strength of at least 80 kgf/mm$^2$ for an automobile, particularly its automatic transmission system.

4 Claims, 2 Drawing Sheets

PROCESS FOR MANUFACTURING HIGH-STRENGTH PARTS OF AN AUTOMOBILE TRANSMISSION SYSTEM

BACKGROUND OF THE INVENTION

1. Field of the Invention

This invention relates to a process for manufacturing high-strength parts of an automobile, particularly of its transmission system.

2. Description of the Prior Art

Hot forging, casting, sintering, etc. have hitherto been employed for making plate carriers and other parts of automatic or other transmission systems in automobiles. Press forming and soft-nitriding or other heat treatment have recently come to be employed for making materials of higher strength to enable the manufacture of automobiles which are lighter in weight and less expensive, and yet ensure a higher level of safety for the driver or passenger. High strength is essentially required of, among others, certain parts including the plate carrier of an automatic transmission.

The manufacture of a high-strength part by press forming necessitates the use of a sheet material having a relatively large thickness in the range of, say, 2 to 6 mm. A hot-rolled steel sheet is usually employed. Attempts have been made to use a hot-rolled steel sheet having a high strength which is equivalent to the strength required of a final product. A high-strength hot-rolled steel sheet is, however, low in press workability and causes a heavy wear to the tool used for its working, and is, therefore, unsuitable for use in the commercial production of any such part.

There is also known a method in which a part formed from mild steel is carburized, nitrided, soft-nitrided, or otherwise treated to acquire a surface having the desired strength and hardness. The product of this method is, however, low in rigidity, particularly in torsional strength and fatigue resistance, since it is not strong enough in its interior as opposed to its surface. There is no alternative but to use a sheet having a larger thickness or rely to a greater extent upon surface-hardening treatment in order to make up for any such drawback. This is contrary to the intention to achieve a reduction in the weight and cost of any such part.

Attempts have been made to overcome these problems by forming a part from carbon steel having a relatively low strength and subjecting it to heat treatment (hardening and tempering). The heat treatment, however, calls for the use of a considerably high temperature in the order of at least 850° C. and necessarily adds greatly to the cost of manufacture including not only the cost of heat treatment itself, but also the cost of rectifying any deformation of the part that may result from its heat treatment.

There are also known methods which rely upon special work to increase the strength of steel, as disclosed in, for example, Japanese Patent Publications Nos. 5616/1976 and 17049/1982. All of these methods have, however, been found only capable of achieving a tensile strength which is lower than 80 kgf/mm$^2$.

SUMMARY OF THE INVENTION

We, the inventors of this invention, have made a careful search for a solution to the problems existing in the prior art as hereinabove pointed out, and found that it is possible to produce a part having high strength, particularly excellent torsional strength and fatigue resistance, from steel having a high degree of cold workability if the chemical composition of the steel and the conditions under which it is processed are appropriately selected.

It is, therefore, an object of this invention to provide a process which is essentially different from the known method involving metallurgical work for achieving an increase of strength, and which can manufacture an automobile part having a tensile strength of at least 80 kgf/mm$^2$ from a hot-rolled steel sheet having a tensile strength not exceeding 65 kgf/mm$^2$, and excellent cold workability.

This object is attained by a process for manufacturing a high-strength automobile part having excellent torsional strength and fatigue resistance which comprises using a hot-rolled steel sheet obtained by heating to a temperature of 1100° C. to 1250° C. steel containing, on a weight percent basis, 0.01 to 0.15% of carbon, 0.05 to 0.50% of silicon, 0.20 to 1.0% of manganese, 0.01 to 0.1% of aluminum, 0.3 to 2.0% of copper, 0.1 to 2.0% of nickel, 0.015 to 0.1% of niobium and 0.0005 to 0.0050% of calcium, the balance of the steel being iron and unavoidable impurities, hot rolling it and coiling the hot-rolled steel at a temperature of 350° C. to 500° C., and having a tensile strength not exceeding 65 kgf/mm$^2$; cold working the sheet to cause a working strain of at least 15% therein; and heating the cold-worked sheet at a temperature of 400° C. to 550° C. for a period of 0.5 to three hours, so that the sheet may have a tensile strength of at least 80 kgf/mm$^2$.

The hot-rolled sheet of steel having the specific chemical composition and particularly containing copper, nickel and niobium has a relatively low strength and excellent cold workability. The cold working of the sheet and the heat treatment of the cold-worked product which are performed under the specific conditions yield a part which has a tensile strength of at least 80 kgf/mm$^2$ and is particularly excellent in torsional strength and fatigue resistance.

Other features and advantages of this invention will become apparent from the following description and the accompanying drawings.

DETAILED DESCRIPTION OF THE INVENTION

Figure 1:
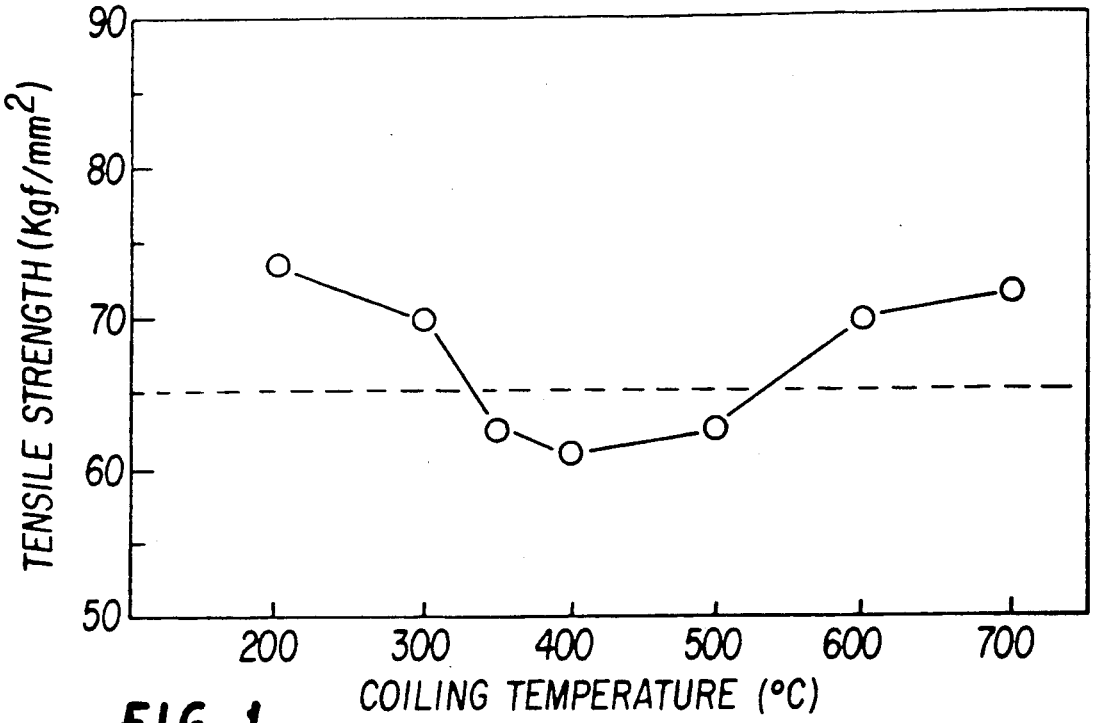
FIG. 1 is a graph showing the tensile strength of hot-rolled steel sheets in relation to the coiling temperature.

The process of this invention is carried out by using a hot-rolled sheet of steel containing, on a weight percent basis, 0.01 to 0.15% of carbon, 0.05 to 0.50% of silicon, 0.20 to 1.0% of manganese, 0.01 to 0.1% of aluminum, 0.3 to 2.0% of copper, 0.1 to 2.0% of nickel, 0.015 to 0.1% of niobium and 0.0005 to 0.0050% of calcium, the balance of its composition being iron and unavoidable impurities.

Carbon is an element which is effective for increasing the strength of a steel sheet. The carbon range of 0.01 to 0.15% by weight is essential to ensure the good cold workability, weldability and rigidity of the steel sheet used for making an automobile part in accordance with this invention. No sheet of steel containing less than 0.01% by weight of carbon can be expected to exhibit the desired strength, while a sheet of steel containing more than 0.15% by weight of carbon is too low in ductility to exhibit good cold workability, and is low in spot weldability, too.

Silicon is an element which is required for deoxidizing steel and forming a solid solution to improve the strength of steel. The silicon range of 0.05 to 0.50% by weight is essential. The addition of only less than 0.05% by weight of silicon is insufficient for making a satisfactorily deoxidized clean steel. If steel contains more than 0.50% by weight of silicon, however, a hot-rolled sheet thereof is low in cold workability, and it is also likely that red scale of silicon may form on a hot-rolled sheet and give it a poor surface showing a higher notch effect which lowers the ductility of the sheet.

Manganese is an element which is essential for improving the hardenability of steel and thereby its strength, and is also required for preventing the embrittlement of steel by silicon when it is hot rolled. No steel containing less than 0.20% by weight of manganese is suitable from a strength standpoint. No steel containing more than 1.0% by weight of manganese is, however, suitable, either, since it has too high a strength, and also since the excessive segregation of manganese in steel results in a sheet having low cold workability. Therefore, the range of 0.20 to 1.0% by weight is essential for manganese.

Aluminum is used as a deoxidizer. The addition of at least 0.01% by weight of aluminum is necessary for that purpose. The addition of more than 0.1% by weight, however, results in an increase of nonmetallic inclusions. Therefore, the range of 0.01 to 0.1% by weight is essential for aluminum.

Copper is an element which is essential for improving the age hardenability of steel. It enables steel to remain relatively soft when hot rolled, but exhibit high strength when cold worked and aged. The copper range of 0.3 to 2.0% by weight is essential for the steel which is used for the purpose of this invention. No steel containing less than 0.3% by weight of copper makes any product having satisfactorily high strength. The addition of more than 2.0% by weight results in the embrittlement of steel when it is hot rolled, and is also likely to lower the cold workability of the steel.

Nickel is effective for increasing the strength of steel and preventing its hot embrittlement. Its proportion is in the range of 0.1 to 2.0% by weight. If its proportion is less than 0.1% by weight, it is insufficient for preventing the hot embrittlement of steel. Steel containing more than 2.0% by weight of nickel is, however, too strong for easy cold working.

Niobium is as effective as copper in enabling steel to remain soft when hot rolled, but exhibit high strength when cold worked and aged. Its proportion is in the range of 0.015 to 0.1% by weight. If its proportion is less than 0.015% by weight, the cold-worked product fails to exhibit any satisfactorily high strength when aged. Steel containing more than 0.1% by weight of niobium is too strong for easy cold working.

Calcium is effective for spheroidizing sulfide in steel and thereby decreasing its mechanical anisotropy and improving its ductility and toughness. A satisfactory result can be obtained when at least 0.0005% by weight of calcium is added. The addition of more than 0.0050% by weight of calcium, however, brings about an increase of nonmetallic inclusions resulting in a steel of low ductility and toughness.

Although the steel may contain unavoidable impurities, it is desirable to remove as far as possible phosphorus, sulfur, oxygen, nitrogen, and other elements that may be detrimental to the cold workability of the steel.

The steel as hereinabove described can be produced by an ordinary steelmaking process. A slab thereof can be made by casting, blooming, or continuous forging.

The steel is heated to a temperature of 1100° C. to 1250° C., and rolled into a sheet. The hot-rolled sheet is coiled at a temperature of 350° C. to 500° C. and usually has a tensile strength of 45 to 65 kgf/mm$^2$. The hot-rolled sheet is cold worked until a working strain of at least 15% is set up. The cold-worked product is heated at a temperature of 400° C. to 550° C. for a period of 0.5 to three hours until it has a tensile strength of at least 80 kgf/mm$^2$ which corresponds to a Rockwell C hardness of 22. The product of the process according to this invention usually has a tensile strength of 80 to 100 kgf/mm$^2$.

The temperature range of 1100° C. to 1250° C. is equal to what is usually employed for herting a slab before it is rolled. If a temperature lower than 1100° C. is employed, a slab of the steel which is used for the purpose of this invention is difficult to roll by an ordinary continuous hot rolling mill, as it contains high proportions of nickel, niobium, etc. If the temperature exceeds 1250° C., the steel undergoes embrittlement when rolled, as is the case with any steel containing copper, despite the fact that it contains nickel, too.

While the process of this invention does not include any particular limitation on the conditions of hot rolling, it is important that the hot-rolled sheet be coiled at a temperature of 350° C. to 500° C. We made a series of experiments to study the effect of the coiling temperature on the tensile strength of a hot-rolled steel sheet. We heated to a temperature of 1200° C. slabs of steel containing, on a weight percent basis, 0.05% of carbon, 0.20% of silicon, 0.49% of manganese, 0.038% of aluminum, 1.02% of copper, 1.00% of nickel, 0.058% of niobium and 0.0018% of calcium, hot rolled them, and coiled the hot-rolled sheets at different temperatures as shown in FIG. 1. The results of our experiments are shown in FIG. 1. Only the sheets that had been coiled at the temperatures of 350° C. to 500° C. showed a tensile strength which was as low as below 65 kgf/mm$^2$.

Figure 2:
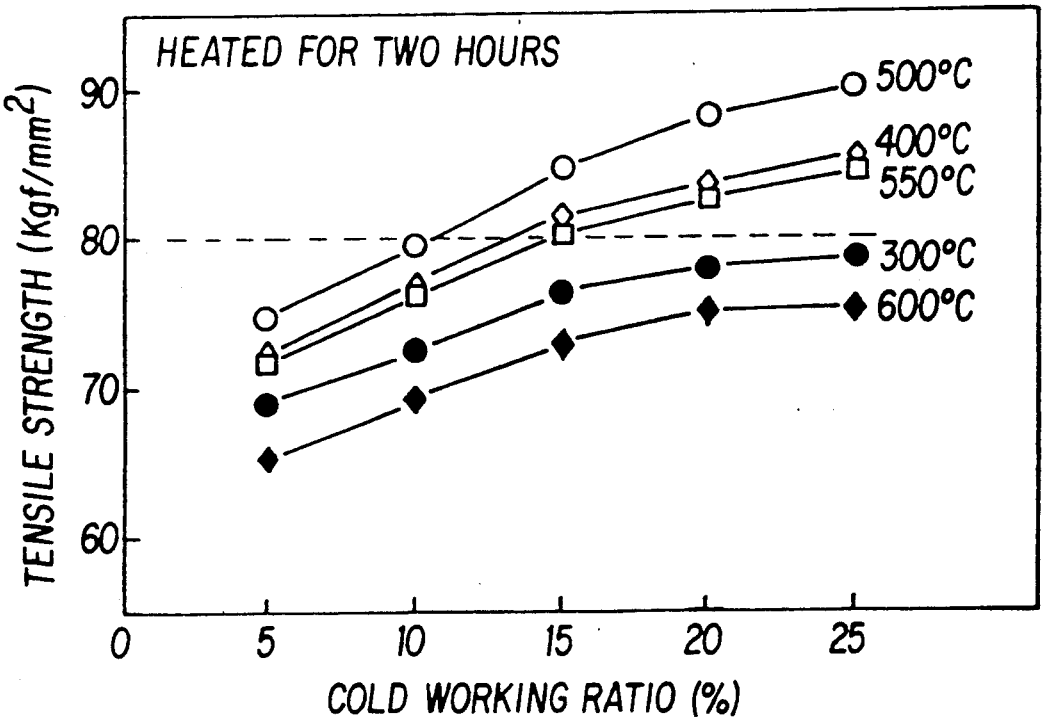
FIG. 2 is a graph showing the tensile strength of cold-worked products in relation to the cold working ratio.

The hot-rolled sheet is cold worked at a working strain or ratio of at least 15% and the cold-worked product is heated for aging at a temperature of 400° C. to 550° C. for a time of 0.5 to three hours, so that it may have a tensile strength of at least 80 kgf/mm$^2$. The hot-rolled sheets which had been coiled at the temperature of 400° C. were cold worked at a working ratio of 15% or above, and the cold-worked products thereof were aged at temperatures of 400° C. to 550° C. All of the products exhibited a tensile strength of 80 kgf/mm$^2$ or above, as shown in FIG. 2. On the other hand, all of the cold-worked products which had been obtained at a working ratio below 15% exhibited only a tensile strength lower than 80 kgf/mm$^2$, even if they had been aged at a temperature of 400° C. to 550° C. No product that had been aged at a temperature below 400° C. or above 550° C. exhibited a tensile strength as high as at least 80 kgf/mm$^2$, emen if it had been cold worked at a working ratio of 15% or above.

Figure 3:
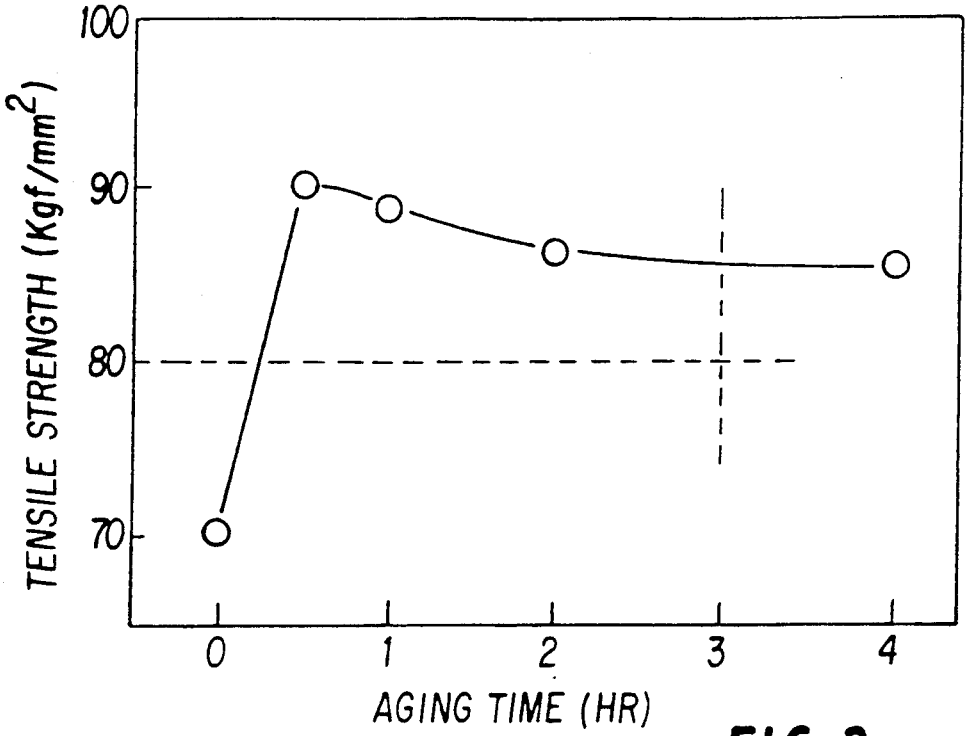
FIG. 3 is a graph showing the tensile strength of cold-worked and aged products in relation to the aging time.

FIG. 3 shows the results of experiments made to ascertain the effect of the heating or aging time on the tensile strength of the product. As is obvious therefrom, an aging time of at least 0.5 hour is required for achieving a tensile strength of at least 80 kgf/mm$^2$. An aging time exceeding three hours is, however, too long from an economical standpoint, though a tensile strength higher than 80 kgf/mm$^2$ can be achieved. Therefore, an aging time of 0.5 to three hours is adopted for the process of this invention.

Although the cold-worked product has been described as being aged to attain the desired tensile strength, similar results can be obtained also by other heat treatment, such as soft-nitriding.

The invention will now be described more specifically with reference to examples, though these examples are not intended for limiting the scope of this invention.

EXAMPLES

Steels #1 to #5 each having the composition shown in TABLE 1 and falling within the range specified according to this invention, and steels #6 to #8 each having the composition shown also in TABLE 1, but deviating from the range according to this invention were heated at the temperatures shown in TABLE 2, and hot rolled into sheets each having a thickness of 4.5 mm. The hot-rolled sheets were coiled at the temperature shown in TABLE 2. Each hot-rolled sheet was cold worked at the working strain shown in TABLE 2 to make a plate carrier front as one of the parts of an automatic transmission. The cold formability of each sheet is shown in TABLE 2 by two symbols, i.e., the circle which means high cold formability, and the x which means low cold formability.

The cold-worked products were aged under the conditions shown in TABLE 2. Then, tensile and torsion tests were conducted on each product. The results of the tests are shown in TABLE 2.

Figure 4:
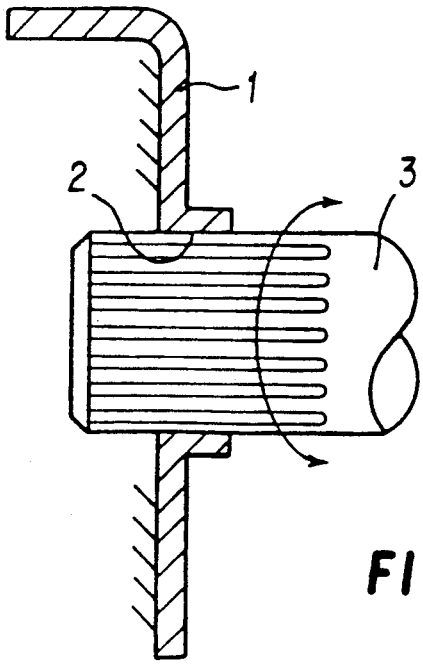
FIG. 4 is a view illustrating a method for a torsion test.

The torsion test was conducted by engaging a spline shaft 3 connected to a torsion tester in a spline hole 2 formed in a sample 1 bolted to a fixed base, and applying a torsional torque to the sample 1 to the shaft 3, as shown in FIG. 4.

TABLE 1

| Steel # | Sheet thickness (mm) | Chemical composition (wt. %) | | | | | | | | | |
|---|---|---|---|---|---|---|---|---|---|---|---|
| | | C | Si | Mn | P | S | Al | Cu | Ni | Nb | Ca |
| Steel according to the invention 1 | 4.5 | 0.05 | 0.20 | 0.49 | 0.015 | 0.007 | 0.038 | 1.02 | 1.00 | 0.058 | 0.0018 |
| Steel according to the invention 2 | 4.5 | 0.05 | 0.20 | 0.50 | 0.016 | 0.007 | 0.038 | 1.52 | 1.20 | 0.058 | 0.0021 |
| Steel according to the invention 2 | 4.5 | 0.11 | 0.19 | 0.52 | 0.014 | 0.005 | 0.035 | 1.01 | 0.99 | 0.060 | 0.0025 |
| Steel according to the invention 2 | 4.5 | 0.06 | 0.20 | 0.51 | 0.013 | 0.006 | 0.028 | 0.80 | 0.76 | 0.085 | 0.0022 |
| Steel according to the invention 2 | 4.5 | 0.05 | 0.19 | 0.48 | 0.014 | 0.007 | 0.034 | 0.50 | 0.49 | 0.065 | 0.0020 |
| Comparative steel 6 | 4.5 | 0.06 | 0.21 | 0.50 | 0.017 | 0.006 | 0.035 | — | 0.80 | 0.095 | 0.0022 |
| Comparative steel 7 | 4.5 | 0.05 | 0.19 | 0.53 | 0.013 | 0.006 | 0.028 | 1.00 | 1.02 | — | — |
| Comparative steel 8 | 4.5 | 0.05 | 0.22 | 0.51 | 0.012 | 0.005 | 0.040 | 2.50 | 2.00 | 0.040 | 0.0035 |

TABLE 2

| Sample | Steel # | Heating temperature (°C.) | Coiling temperature (°C.) | Cold working strain (%) | Cold formability | Aging | | Tensile strength (kgf/mm$^2$) | Torsional strength (kg-m) | Fatigue strength (μm) |
|---|---|---|---|---|---|---|---|---|---|---|
| | | | | | | Temperature (°C.) | Time (h) | | | |
| Sample of product of the invention a | 1 | 1180 | 400 | 15 | ○ | 550 | 2.0 | 83.5 | ○ | ○ |
| Sample of product of the invention b | 1 | 1180 | 450 | 30 | ○ | 550 | 1.0 | 86.2 | ○ | ○ |
| Sample of product of the invention c | 2 | 1180 | 400 | 20 | ○ | 500 | 2.0 | 91.3 | ○ | ○ |
| Sample of product of the invention d | 3 | 1230 | 400 | 20 | ○ | 500 | 2.0 | 92.6 | ○ | ○ |
| Sample of product of the invention e | 3 | 1230 | 450 | 15 | ○ | 550 | 2.0 | 90.3 | ○ | ○ |
| Sample of product of the invention f | 4 | 1230 | 450 | 20 | ○ | 550 | 1.0 | 82.8 | ○ | ○ |
| Sample of product of the invention g | 4 | 1230 | 450 | 20 | ○ | 500 | 1.0 | 83.7 | ○ | ○ |
| Sample of product of the invention h | 5 | 1230 | 450 | 30 | ○ | 500 | 1.0 | 80.5 | ○ | ○ |

TABLE 2-continued

| Sample | Steel # | Heating temperature (°C.) | Coiling temperature (°C.) | Cold working strain (%) | Cold formability | Aging Temperature (°C.) | Aging Time (h) | Tensile strength (kgf/mm²) | Torsional strength (kg-m) | Fatigue strength (μm) |
|---|---|---|---|---|---|---|---|---|---|---|
| Comparative sample i | 6 | 1180 | 400 | 15 | ○ | 550 | 1.5 | 72.4 | X | X |
| Comparative sample j | 7 | 1180 | 400 | 20 | ○ | 550 | 1.5 | 75.6 | X | X |
| Comparative sample k | 8 | 1180 | 450 | 20 | X | — | — | — | — | — |
| Comparative sample l | 1 | 1230 | 600 | 25 | X | — | — | — | — | — |
| Comparative sample m | 2 | 1230 | 650 | 25 | X | — | — | — | — | — |
| Comparative sample n | 3 | 1180 | 300 | 30 | X | — | — | — | — | — |
| Comparative sample p | 5 | 1180 | 450 | 30 | ○ | 550 | 0.3 | 78.7 | X | X |
| Comparative sample q | 5 | 1180 | 450 | 20 | ○ | 300 | 4.0 | 70.5 | X | X |
| Comparative sample r | 5 | 1230 | 400 | 20 | ○ | 600 | 2.0 | 71.4 | X | X |
| Comparative sample s | 5 | 1230 | 400 | 20 | ○ | 600 | 4.5 | 70.8 | X | X |

The test consisted of a static torsion test and an endurance or fatigue test.

The static torsion test was performed by applying a static torsional torque to the sample in one direction alone, and finding from a torque-angle curve the maximum torque which caused the sample to break. When the maximum torque was 300 kg.m or above, the sample was considered acceptable, as indicated by a circle in TABLE 2, but when it was below 300 kg.m, the sample was considered unacceptable, as indicated by an x in TABLE 2.

The fatigue test was conducted by measuring the width b of the spline grooves, applying a torque of 75 kg.m to the sample 100,000 times, while oscillating it at a frequency of 5 Hz, and measuring the spline groove width again to determine its difference b from the initial value. When the difference b was smaller than 10 microns, the sample was considered acceptable, as indicated by a circle in TABLE 2, but when it was 10 microns or larger, the sample was considered unacceptable, as indicated by an x in TABLE 2.

As is obvious from TABLE 2, all of the samples according to this invention were high in cold formability, and yet exhibited a tensile strength as high as at least 80.5 kgf/mm² and were excellent in both torsional strength and fatigue resistance. On the other hand, the comparatives samples were inferior in cold formability, tensile strength, torsional strength and fatigue resistance, though some of them showed good formability.

What is claimed is:

1. A process for manufacturing a high-strength automobile part having high torsional strength and fatigue resistance consisting essentially of:

heating to a temperature of 1100° C. to 1250° C. steel containing, on a weight percent basis, 0.01 to 0.15% of carbon, 0.05 to 0.50% of silicon, 0.20 to 1.0% of manganese, 0.01 to 0.1% of aluminum, 0.3 to 2.0% of copper, 0.1 to 2.0% of nickel, 0.015 to 0.1% of niobium and 0.0005 to 0.0050% of calcium, the balance of said steel being iron and unavoidable impurities;

hot rolling said steel;

coiling said hot-rolled steel at a temperature of 350° C. to 500° C. to prepare a hot-rolled steel sheet having a tensile strength not exceeding 65 kgf/mm²;

cold working said sheet until a working strain of at least 15% is set up; and heating said cold-worked product at a temperature of 400° C. to 550° C. for a period of 0.5 to three hours, so that said product may have a tensile strength of at least 80 kgf/mm².

2. A process as set forth in claim 1, wherein said sheet has a tensile strength of 45 to 65 kgf/mm² and said product has a tensile strength of 80 to 100 kgf/mm².

3. A process as set forth in claim 1 or 2, wherein said automobile part is of an automatic transmission system.

4. A process as set forth in claim 3, wherein said steel is heated at a temperature of 1180° C. to 1230° C., said hot-rolled steel is coiled at a temperature of 400° C. to 450° C., said strain is from 15 to 30%, and said cold-worked product is heated at a temperature of 500° C. to 550° C. for one to two hours.

* * * * *